US005566981A

United States Patent [19]

Alcordo

[11] Patent Number: 5,566,981

[45] Date of Patent: Oct. 22, 1996

[54] POSTCARD BANK CHECK

[76] Inventor: Isabelo S. Alcordo, 613 Summit St., Wachula, Fla. 33873

[21] Appl. No.: 409,159

[22] Filed: Mar. 23, 1995

Related U.S. Application Data

[63] Continuation-in-part of Ser. No. 270,736, Jul. 5, 1994, abandoned.

[51] Int. Cl.[6] ..... B42D 15/00

[52] U.S. Cl. ..... 283/58; 283/57; 229/92.8

[58] Field of Search ..... 283/57–59; 229/92.1, 229/92.8, 72, 92

[56] References Cited

U.S. PATENT DOCUMENTS

| | | | |
|---|---|---|---|
| 2,374,723 | 5/1945 | Barghausen | 283/58 X |
| 2,536,371 | 1/1951 | Hutchison | 283/58 X |
| 3,672,703 | 6/1972 | Jay | 283/58 X |
| 4,231,593 | 11/1980 | Bell, Jr. et al. | 283/58 X |
| 4,948,174 | 8/1990 | Thomson et al. | 283/58 |
| 4,974,878 | 12/1990 | Josephson | 283/58 X |
| 5,085,470 | 2/1992 | Peach et al. | 283/58 |

FOREIGN PATENT DOCUMENTS

| | | | |
|---|---|---|---|
| 8200844 | 10/1983 | Netherlands | 283/58 |

*Primary Examiner*—Frances Han
*Attorney, Agent, or Firm*—Frank A. Lukasik

[57] ABSTRACT

The invention is a bankable apparatus or post card bank check for sending contributions by mail without the use of any letter envelope. The post card bank check carries with it the dollar value of the instrument of such denominations as the issuing banks may determine and as the buyer may choose for the purpose of sending money from the sender to the recipient. The post card check is for deposit only and withdrawable only with the use of the recipient's own bank check making it a safe way to transfer money from donor to recipient.

2 Claims, 4 Drawing Sheets

POSTCARD BANK CHECK

RELATED PATENT APPLICATION

This is a continuation-in-part of patent application Ser. No. 08/270,736, filed Jul. 5, 1994, now abandoned the disclosures of which are incorporated by reference.

BACKGROUND OF THE INVENTION

1. Field of the Invention

This invention relates to a bankable apparatus or item for sending small amounts of money by mail, particularly to religious and/or non-profit organizations that are soliciting donations from the general public.

2. Discussion of the Prior Art

The present situation in the United States is that most persons receive in their mails a number of solicitations a month for donations from various religious and/or non-profit organizations. These lead to a number of problems which are:

(1) For one receiving 10 to 20 solicitations per month, a donation of $1.00, $2.00, $5.00, $10.00, or $20.00 per donation would cost a minimum of $10.00 to a maximum of $400.00 dollars per month. To one with a generous heart, but a very limited means such a person goes through a lot of mental anguish each month as he/she tries to determine who gets his/her donation and how much.

(2) After the decision is made as to how many charities and how much each gets his/her donation for the month he/she then goes through much hassle. He/she must (a) write the name of the charity/church on a personal check, (b) sign the check, (c) place the check inside an envelope, (d) lick the envelope, (e) close the envelope, (f) buy a postage stamp, (g) lick the stamp, and (h) stick the stamp on the envelope.

The above are not small matters when one is giving to as many as 10 to 20 charities/churches each month. The postage stamps alone would cost from $2.90 to $5.80 each month. There is also the cost of using 10 to 20 personal checks and the headache of reconciling the checking accounts, what with so many checks being issued each month. They are irritating and they discourage giving. These problems are real not only to the proponent of the instant invention but also to tens of millions of kind-hearted charity donors in the U.S. and in all of the advanced countries in the world.

The instant invention of a directly mailable postcard-type check, personal or otherwise, significantly minimizes these problems. Also, a reduction in postage for checks mailed in envelopes from $0.32 to $0.20 for postcards means a savings to the donor of $0.10 per mailed donation.

SUMMARY OF THE INVENTION

Accordingly, it is a purpose of the invention to provide a directly and immediately mailable postcard-type bankable apparatus or item, in the form of a bank check—personal or otherwise—for the purpose of sending money by mail.

In carrying out the purpose of the invention in the illustrative embodiment thereof, a paper material of such thickness and quality acceptable to the Postmaster General of the United States for the granting of a FIRST CLASS MAIL PERMIT will be used. The shape and dimensions of the postcard bankcheck of the invention may be that of a personal bank check, that of a small letter envelope or that of a regular picture postcard.

Upon the granting of a FIRST CLASS MAIL PERMIT, the statement "NO POSTAGE NECESSARY IF MAILED IN THE UNITED STATES" is printed on the right hand upper corner of the address side of each postcard bank check, meeting all of the requirements of law as to the registration of the numerical volume being printed. Also on the address side, is the name and address of the charity for the purpose of mailing and for crediting the amount to the account of the charity thus named. At the left hand upper corner of the postcard bank check is the name and address of the donor or sender.

On the other side of the postcard bank check, that is, the back of the address side, is the face of the bank check on which the following information is found: the dollar value of the item or apparatus or check in figures and in words, the name and address of the issuing bank, such security codes and check series numbers that the bank may require the printer of the postcard bank check to include, and the statement "FOR DEPOSIT ONLY" below the amount on the face of the postcard bank check. The recipient charity can withdraw the amount only with the use of its own checks. The postcard bank checks may be issued in booklets of 10 to 20 checks consisting of one denomination or a combination of various denominations such as $0.50, $1.00, $2.00, $5.00 for total booklet values of from $5.00 to $100.00.

DESCRIPTION OF THE PREFERRED EMBODIMENT

Figure 1:
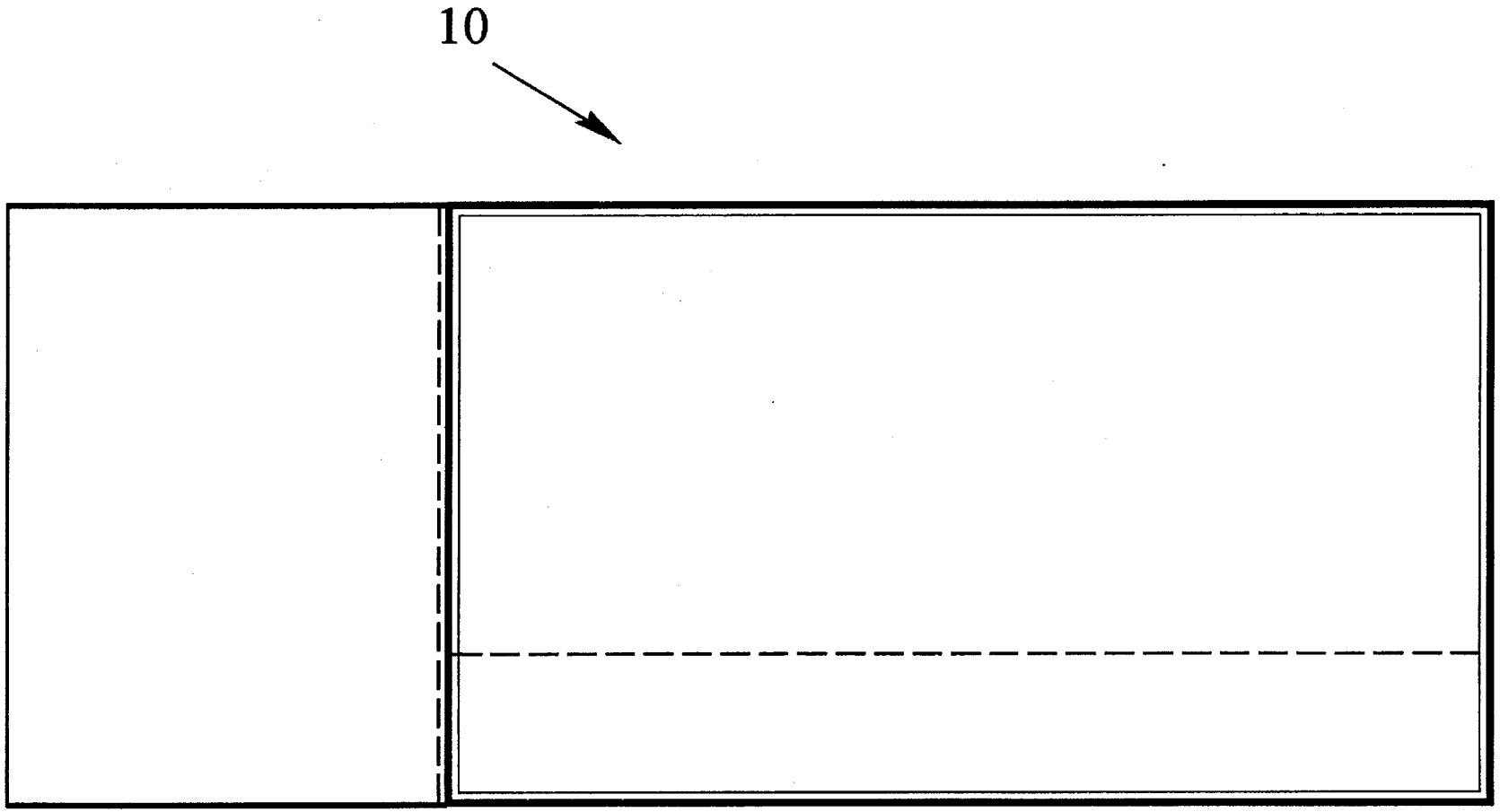
FIG. 1 is a top plan view of a card stock with a perforation for removal of a stub.
Figure 2:
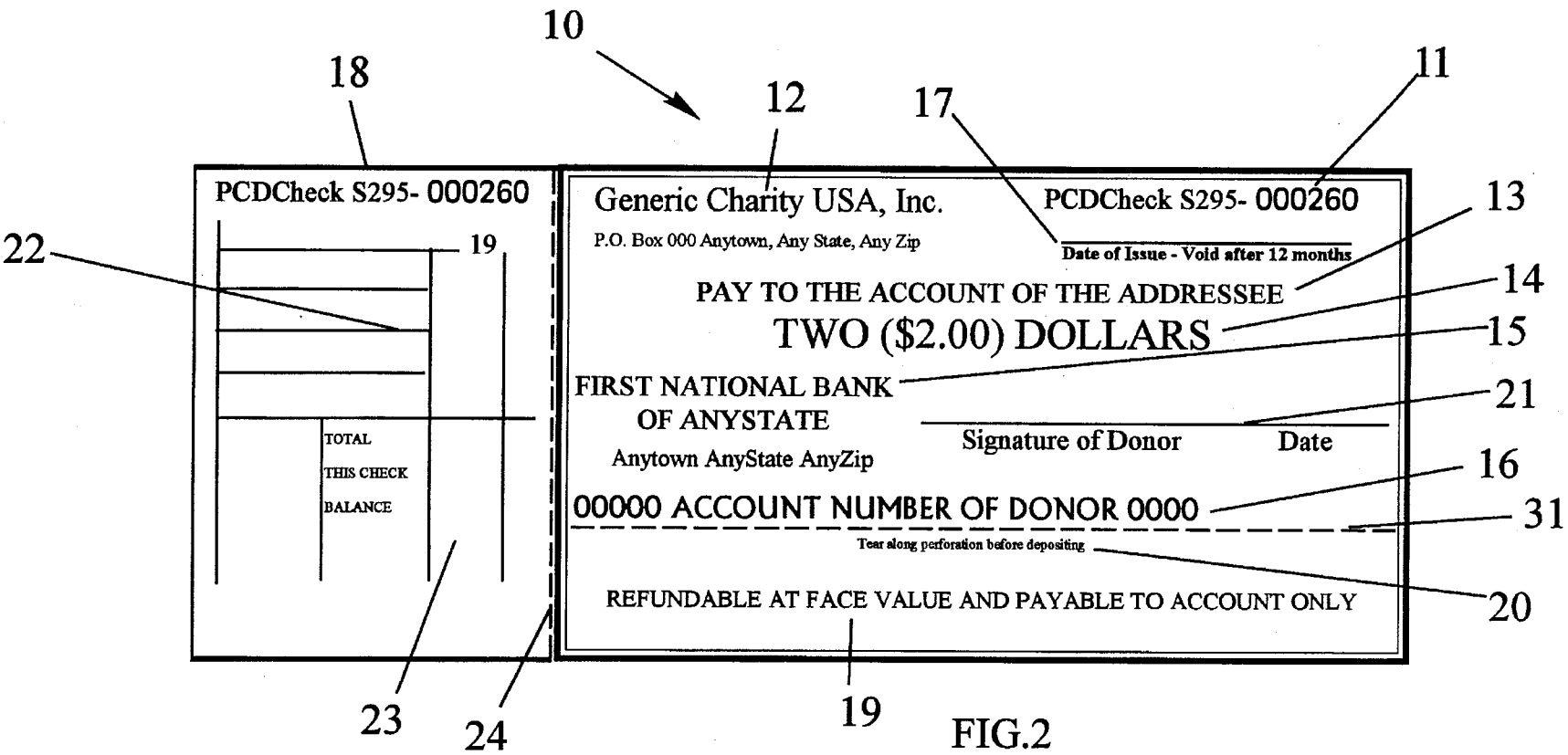
FIG. 2 is a top plan view of the face side of a post card check in accordance with the invention.

Referring to FIG. 1 there is shown the blank card stock for the post card check designated by the numeral 10. FIG. 2 is the face side of post card check 10 when first printed and may be a flat, rectangular item, made of any suitable material, and decorated in any manner, and may be of any suitable size and dimension, but preferably that of a small mailing envelope or that of a regular picture postcard.

On the check side, or face of each postcard bank check 10, are printed the check number 11, the addressees name and address 12, instructions to the bank with regards to the addressee 13, the amount of the donation 14, the address of the financial institution 15 upon which the check is drawn and the account number 16, printed in machine readable language. Also included are the date of donation and period of validity 17 of the check 10. A detachable stub 18, is provided for record keeping for tax or business purposes. A notice 19, limiting negotiability of the check is also provided. Instructions 20 are provided for removing the perforated tab 31. A signature space 21 is provided for the donor's signature and the date of signature. The detachable stub 18 contains space 22 for the donor to record the details of the check, a space 23 for the donor to update account information after donation, and a perforated edge 24 for detaching stub 18.

On the reverse side of the post card check 10, is the notice 25, signifying space for the donor's name and address, a notice 26, to caution the donor, not to omit name and address, space 27, for addressee's name and address, a space 28 for the addressee's endorsement, and instructions 29, to the donor showing where to write a memo and where to leave blank for bank use.

Figure 3:
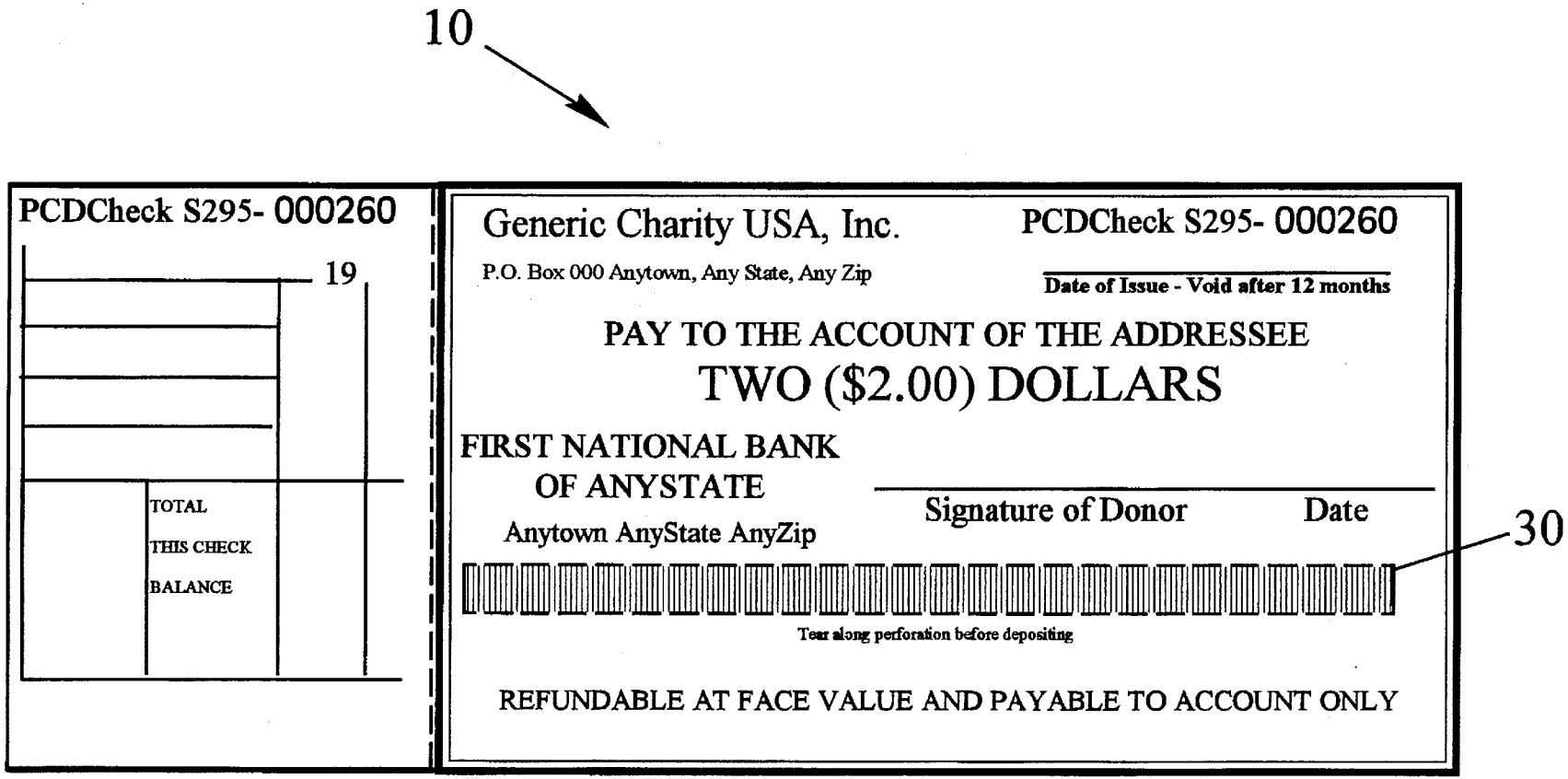
FIG. 3 is a top plan view of the face side of a post card check with a security overlay in place.
Figure 4:
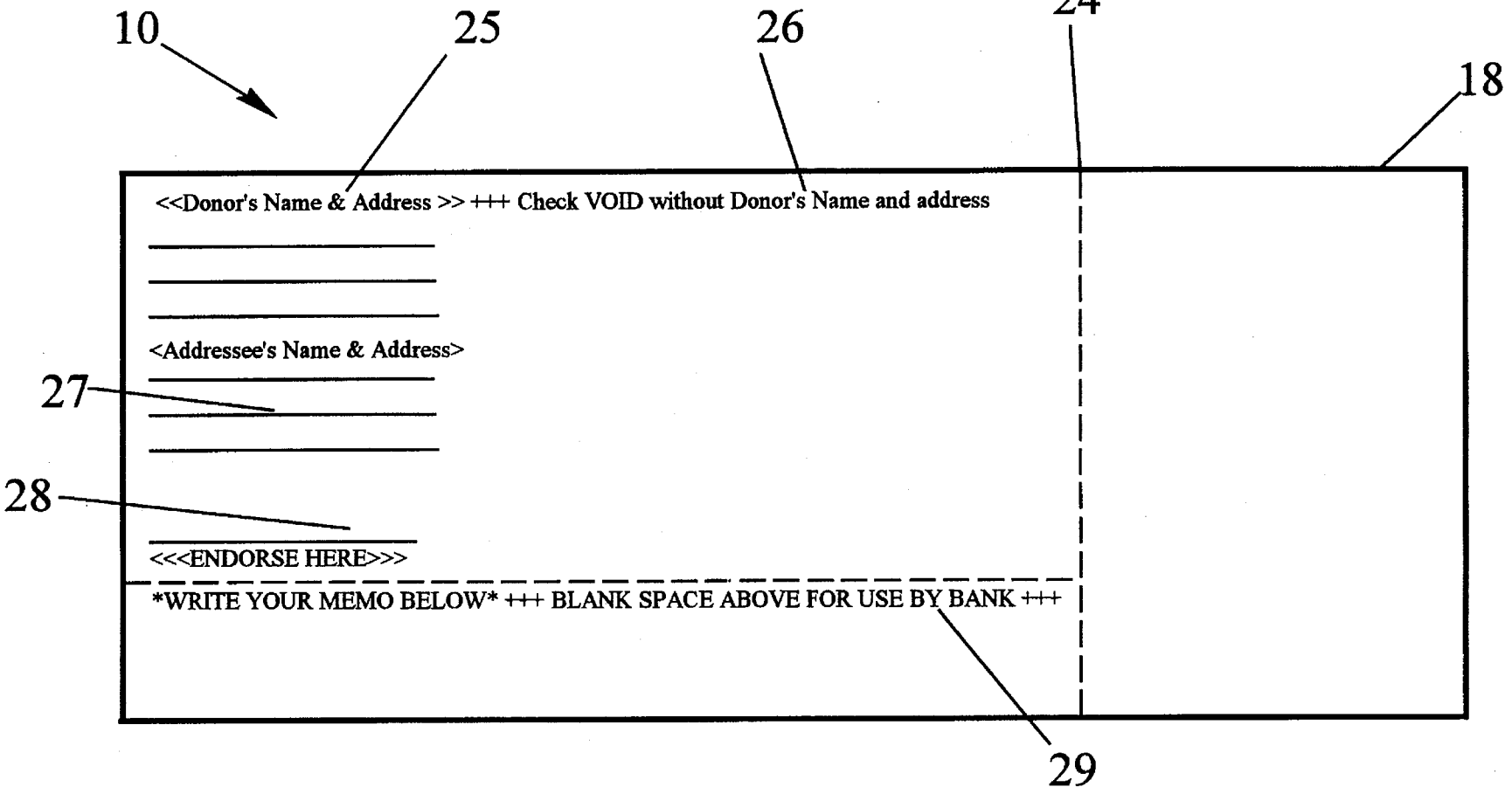
FIG. 4 is a reverse side of a post card check showing details of addressee, donor, etc.

FIG. 3 shows the face side of the post card check 10, with a removable overlay 30, covering the account number 16 for security. The overlay 30 is a strip of card stock having an easily removable adhesive to facilitate the removal of the overlay 30. The overlay 30 may be placed over and used to cover the account number 16 while it is being processed or in mail handling.

At the right hand upper corner of the reverse side of post card check 10 is the position for a Postcard stamp or a regular postal marking of a letter envelope or postcard for which a FIRST CLASS MAIL PERMIT has been granted with the statement "NO POSTAGE NECESSARY IF MAILED IN THE UNITED STATES" (not shown). Most charitable agencies suggest that the donor place the postage on the envelope to save needed charitable contributions. The stamp becomes a part of the contribution. In those cases where a forwarding envelope is provided, the postage would not be required.

The post card checks 10 of the invention should be withdrawable only with the use of the recipient or receiving charity's bank checks. Unused post card checks 10 would be refundable. Should the holder decide not to use the post card checks 10, the issuing bank should refund the holder upon demand if these are surrendered before the expiration date. The post card checks 10 may be issued in booklets consisting of 5, 10 or 20 individual checks with face value of $1.00, $2.00, $5.00, or $10.00 for total values ranging from $5.00 to $200.00 per booklet.

Post card bank checks 10 may be sponsored by a recipient charity with the charity's name already printed as recipient, or unsponsored, therefore without the name of any particular charity. The post card checks 10 may be made available to the public through several channels. A first source may be a corporation organized independent of banks. A volume of checks 10 with a total agreed value may be sponsored by a charity. Such checks 10 are printed and sold for a sponsoring charity with the name and address of the charity printed on the address side of the individual checks 10. Non-sponsored or open checks 10 may also be printed and sold without the name and address of any particular charity. The corporation is responsible for cashing these checks 10 from the recipient charities through normal business transactions and the banking process.

Banks may also be Suppliers of checks 10 through their normal check printers. The banks then sell these sponsored or non-sponsored checks 10 to the general banking public at the counters at such a price so as to cover its printing costs and profits, its banking services costs, and its business profits. The banks redeem these checks 10 from the recipient charities through the normal banking process.

Public charities and religious or non-profit organizations, e.g., United Charity, in connection with its annual fund raising campaign, may arrange with 100 name banks for each bank to issue 10,000 checks 10, each check having a face value of $2.00 for a total value of $2 million, with United Charity as the beneficiary. The 100 name banks then distribute these checks 10 to their respective branches to be displayed and sold at the counter to the general public at face value. United Charity supports the bank's selling campaign with advertisements in the media enticing the public to make its donations by using Checks 10 to make it convenient to the donors to send their donations. When the public buys these checks 10 from the issuing banks, the banks then deposit the proceeds under their checks 10 accounts. The public may then make its donations by mailing these checks 10 to United Charity. When United Charity receives these checks 10, it then turns these over to the respective issuing name banks for deposit under its accounts. The issuing name banks credit the money value of these donations to the accounts of the United Charity which can be withdrawn only by United Charity bank checks 10. The individual issuing banks then bill United Charity for their services on the basis of the amounts each has redeemed. The above example may be used as a business procedure to sell post card checks 10 to the various religious and non-profit organizations with the participation of a sponsoring financial institution.

As another example, the U.S. Postal Service may also sell checks 10 just as postage stamps are sold, in booklets with certain number of checks 10 in various denominations, or the way Postal Money Orders are sold to the public. The checks 10 are then redeemed in the usual way that Postal Money Orders are redeemed.

For non-sponsored checks 10, charity donors buy a booklet of checks 10 for the month or pay period when they deposit their pay checks at the banks choosing the desired denomination and the total number of checks 10 in a booklet. When the potential donors decide how much to donate to each charity, then they separate one of the checks 10 with the appropriate value, write the name and address of the charity, place a Post Card value stamp in the proper position on the reverse side of the check 10, and drop the check 10 in the mailbox.

For sponsored checks 10, the donors select and buy a booklet of checks 10 sponsored by their favorite charity with the desired denominations. When they receive a solicitation from their favorite charity they just have to tear off one check 10 and, if the appropriate postage is applied, drop the check 10 in the mailbox. The checks 10 are then processed in the ordinary course of business in the banking community.

Some minor changes and modifications may vary to meet present and future postal and bank security and other requirements, the invention is not considered limited to the specific examples chosen for the purposes of illustration, and includes all changes and modifications which do not constitute a departure form the true spirit and scope of this invention as claimed in the following claims and reasonable equivalents to the claimed elements.

What is claimed is:

1. A post card bank check for sending contributions by mail comprising:

a sheet of card stock having a face side and a reverse side and a first and second perforation means for separating portions of said card stock into a first, a second, and a third severable part, an image of a check printed on said face side of said first severable part, said image including a plurality of check information items, said check information items including, the check number, the addressee's name and address, instructions to bank with reference to addressee, the amount of the donation, the address of the financial institution, the account number, the date of the donation and period of validity of the check, a notice limiting negotiability of the check, donor's signature and date, a space for the donor to record details of a check, an image of a postcard printed on said reverse side of said first severable part of said point card, said image including a notice signifying space for donor's name and address, a note to caution donor, a space for addressee's name and address, and a space for addressee's endorsement, an image of a donation record printed on said face side of said second severable part, including a space for donor to record details of the check, a space for updating account information after donation, an image of instructions printed on said face side of said third severable part including instructions for removing said third severable part, and a notice limiting negotiability of the check, and, an image of instructions printed on said reverse side of said third severable part including instructions to donor for using said reverse side.

2. A post card bank check of claim 1 wherein:

said account number is concealed by a removable overlay covering said account number during mail processing.

* * * * *